United States Patent [19]

Keane

[11] Patent Number: 4,704,200

[45] Date of Patent: Nov. 3, 1987

[54] METHOD OF SEPARATING OIL OR BITUMEN FROM SURFACES COVERED WITH SAME

[75] Inventor: James Keane, York, Pa.

[73] Assignee: Linnola Limited, Dublin, Ireland

[21] Appl. No.: 661,719

[22] Filed: Oct. 17, 1984

Related U.S. Application Data

[63] Continuation of Ser. No. 274,433, Jun. 17, 1981, abandoned.

[51] Int. Cl.[4] ..... C10G 1/04

[52] U.S. Cl. ..... 208/390

[58] Field of Search ..... 208/11 LE, 348, 390

[56] References Cited

U.S. PATENT DOCUMENTS

| | | | |
|---|---|---|---|
| 2,215,190 | 9/1940 | Pier et al. | 208/348 |
| 2,825,677 | 3/1958 | Coulson | 208/11 LE |
| 2,885,339 | 5/1959 | Coulson et al. | 208/11 LE |
| 2,924,565 | 2/1960 | Stegemeier et al. | 208/11 LE |
| 3,041,267 | 6/1962 | Frame et al. | 208/11 LE |
| 3,436,318 | 4/1969 | Glass | 203/68 |
| 3,553,099 | 1/1971 | Savage et al. | 208/11 LE |
| 4,046,669 | 9/1977 | Blaine | 208/11 LE |
| 4,055,480 | 10/1977 | Smith et al. | 208/11 LE |
| 4,057,486 | 11/1977 | Meadus et al. | 208/11 LE |
| 4,096,057 | 6/1978 | Porrett et al. | 208/11 LE |
| 4,174,263 | 11/1979 | Veatch et al. | 208/11 LE |
| 4,217,202 | 8/1980 | Paraskos et al. | 208/11 LE |
| 4,229,281 | 10/1980 | Alquist et al. | 208/11 LE |
| 4,238,315 | 12/1980 | Patzer | 208/11 LE |
| 4,240,897 | 12/1980 | Clarke | 208/11 LE |
| 4,342,639 | 8/1982 | Gagon | 208/11 LE |
| 4,596,651 | 6/1986 | Wolff et al. | 208/390 |

FOREIGN PATENT DOCUMENTS

| | | | |
|---|---|---|---|
| 602087 | 7/1960 | Canada | 208/11 LE |

*Primary Examiner*—J. E. Evans
*Assistant Examiner*—Joseph A. Boska
*Attorney, Agent, or Firm*—Schwartz, Jeffery, Schwaab, Mack, Blumenthal & Evans

[57] ABSTRACT

The separation of oil or bitumen from a surface of a substrate covered with same is effected by first dissolving the oil or bitumen in a solvent to form a solution thereof. A liquid which does not dissolve the oil or bitumen, is non-miscible with the solvent and has substantially higher surface wetting properties than the solvent on subtstrate is then intimately contacted with the surface of the substrate; the solvent and liquid are capable of forming in the presence of the oil or bitumen an interfacial membrane-like material which is impermeable thereto. The intimate contacting of this liquid with the surface of the substrate causes the membrane-like material to form at the surface of the substrate while the liquid wets the surface and spreads thereover, the liquid displacing the membrane-like material away from the surface as it is being formed thereacross to thereby separate the solution from the surface and cover the surface with a layer of the liquid; the membrance-like material acts as a barrier to maintain the oil or bitumen in the solution and to prevent passage of same into the layer of liquid. The method of the invention avoids the use of surfactants and the formation of emulsions, and thus the problems associated therewith. The invention finds a particular application in the recovery of oil and bitumen from bitumen covered tar sands and oil sands from oil wells.

23 Claims, 2 Drawing Figures

METHOD OF SEPARATING OIL OR BITUMEN FROM SURFACES COVERED WITH SAME

This is a continuation of application Ser. No. 274,433, filed June 17, 1981, now abandoned.

BACKGROUND OF THE INVENTION

1. Field of the invention

The present invention relates to a method of separating oil or bitumen from surfaces covered with same either to clean the surfaces, such as concrete or metal surfaces which have become oil contaminated, or to recover the oil or bitumen therefrom. The invention is particularly directed towards the recovery of oil and bitumen from bitumen covered tar sands and oil sands from oil wells.

2. Description of the Prior Art

Solvents and surface charge modifiers have been used to clean oily surfaces but the result often includes an oil/water emulsion which is undesirable. Also, such methods involve large amounts of water or other solvent where the surface area to be cleaned is large. If the substrate is in the form of a sand, as in the case of oil bearing sands, the grain size can be so small that the total extended surface area per unit volume is extremely large. If solvent soluble surfactants or other chemical aids are used, then the residual quantities in the wet sand residue can be sufficiently great as to seriously affect the process economics.

SUMMARY OF THE INVENTION

It is an object of the invention to overcome the above drawbacks and to provide a method of separating oil or bitumen from surfaces covered with same, which avoids the use of surfactants and does not result in the formation of emulsions.

According to the present invention, the separation of oil or bitumen from a surface of a substrate covered with same is effected by first dissolving the oil or bitumen in a solvent to form a solution thereof. A liquid which does not dissolve the oil or bitumen, is non-miscible with the solvent and has substantially higher surface wetting properties than the solvent on the substrate is then intimately contacted with the surface of the substrate; the solvent and liquid are capable of forming in the presence of the oil or bitumen an interfacial membrane-like material which is impermeable to the oil or bitumen. The intimate contacting of the liquid with the surface of the substrate causes the membrane-like material to form at the surface of the substrate while the liquid wets the surface and spreads thereover, the liquid displacing the membrane-like material away from the surface as it is being formed thereacross to thereby separate the solution from the surface and cover the surface with a layer of the liquid; the membrane-like material acts as a barrier to maintain the oil or bitumen in the solution and to prevent passage of same into the layer of liquid.

The invention is based on the use of two liquids having specific properties relative to one another, to the substrate as well as to the oil or bitumen deposited on the latter. The first serves as a solvent to form a solution of the oil or bitumen and the second as a displacing medium to dislodge with the aid of the membrane-like barrier formed at the interface the oil or bitumen laden solvent from the surface of the substrate and to form a layer of liquid wetting the surface and thus separating the solution from the surface. The unexpected formation of the interfacial membrane-like barrier which has been found to occur when using two liquids having substantially high interfacial tension relative to one another in the presence of oil or bitumen permits the complete removal of the oil or bitumen from the surface of the substrate.

Thus, the solvent must be a good solvent for the oil or bitumen and have low surface wetting properties on the substrate. The displacing liquid, on the other hand, must be non-solvent, non-miscible with the solvent and have high surface wetting properties on the substrate. In addition, as already stated, both must have high interfacial tension relative to one another so as to form in the presence of the oil or bitumen the interfacial membrane-like barrier which is required for a complete oil or bitumen removal.

Preferably, the solvent has a substantially lower boiling point and higher density than the displacing liquid. The former property permits a low energy recovery of the solvent while the latter property enables the displacing liquid to float on top of the solution and to thereby control the evaporation of the low boiling point solvent.

As examples of solvents meeting the above characteristics, the halogenated hydrocarbons can be mentioned Among these, the chlorinated hydrocarbons such as methylene chloride, trichlorethylene and perchlorethylene and the fluorinated hydrocarbons such as those available under the trademark FREON, particularly FREON TF (trichlorotrifluorethane) have given excellent results. As examples of displacing liquids which can be used in the practice of the invention, water and alcohols such as ethyl alcohol can be cited. It is to be understood, however, that these are given for illustrative purpose only and that the method of the invention is by no way limited to such examples. One must merely make a selection based on the criteria set forth above, which can be assisted by computer or other search means, to apply the method to all of the available solvent - displacing liquid combinations which meet the criteria.

Some systems form membranes composed of chemical compounds at the interface, for instance nylon. This, however, is not the type of membranes with which the present invention is concerned since in the method of the invention no chemical reaction occurs at the interface and therefore no chemical compounds are formed. In the context of the present invention, the interfacial membranes are rather formed of a mixture of dissimilar materials, stabilized temporarily by the electrostatic forces present at the interface due to the surface energy effect. Such interfacial membranes cannot be isolated from their liquid medium, as opposed to conventional membranes, but have most of the physical characteristics of a membrane, such as thickness, opacity, strength and structural stability, while in their liquid medium.

Either the solvent or displacing liquid can be added first, or both can be added simultaneously. If the displacing liquid is added first or simultaneously with the solvent, it will be rejected by the oil or bitumen layer on the substrate and does not inhibit the solvation by the solvent since it will float on top of the solvent in the absence of agitation. However, for practical reasons, the solvent is preferably added first.

The contacting of the displacing liquid with the surface of the substrate can be effected by simple mechanical agitation of the solution, liquid and substrate together. Where the substrate is in granular form, such as sand grains, a mixer or attrition mill can be used to provide grinding and tumbling of the sand grains. The grinding action of the grains vigorously rubbing against each other provides many opportunities for the displacing liquid to contact the surfaces of the grains and immediately spread thereacross, and also for a sand grain already covered with a layer of liquid to transfer part of its surface layer to a non-wet grain while in contact with it. Thus, a wetting action is initiated each time a wet grain contacts a non-wet one.

Since trace amounts of the solvent inevitably show up in the displacing liquid, it might be necessary from the economics viewpoint to recover the solvent from the liquid layer covering the substrate. This can be done by using fresh liquid in a final wash of the substrate so as to carry off the solvent dissolved in the liquid layer. The loss of solvent and displacing liquid into each other can also be minimized by lowering the temperature of the solvent and displacing liquid prior to mixing, to a limit set by the higher of their respective freezing points. At reduced temperature, the interfacial tension between the solvent and displacing liquid is increased and the displacing action of the latter is improved due to the lower solubility of the solvent in the liquid; also, where a low boiling point solvent is used, such solvent has less tendency to boil off during the grinding of sand grains. When using a liquid other than water as displacing liquid, a displacing liquid recovery step can be added, depending on the cost or other considerations of the use of a recovery step for it.

BRIEF DESCRIPTION OF THE DRAWINGS

The invention will be better understood by the following description of experimental work and of the application of the method to the recovery of oil and bitumen from tar and oil sands, given for illustrative purpose only, reference being made to the appended drawings, wherein.

DESCRIPTION OF THE PREFERRED EMBODIMENTS

Figure 1:
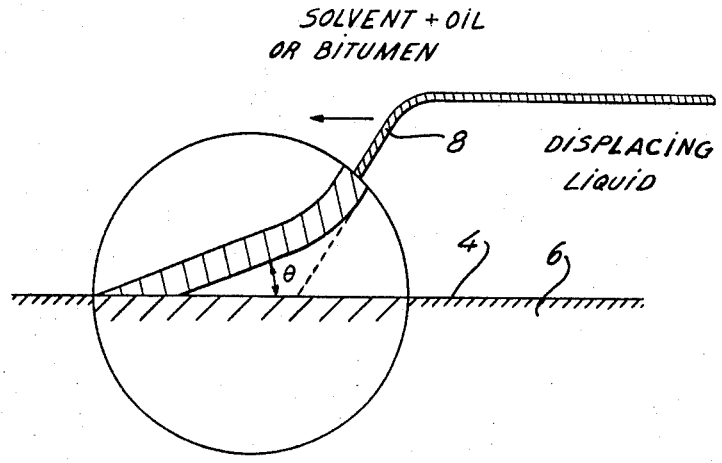
FIG. 1 is a schematic diagram showing the displacing action of the liquid on the interfacial membrane as it is being formed across the surface of a substrate.

An experiment was performed using two nonmiscible liquids, methylene chloride and water. First the two liquids were added to a flask and allowed to separate forming an interfacial film. The water settled on top of the methylene chloride, since the specific gravity of the latter is 1.34. The interface was probed with a 1 cm square wire frame, and its film like characteristic was determined. Extensions of the interface were fragile and could only be maintained with difficulty. The interfacial film that was formed was easily broken and did not have the characteristics of a membrane but rather that of a film which promptly heals if it is ruptured. Thus, if a bubble is introduced below the film, it will be trapped if it is small enough. If it is large enough to break through the film, then it does so by quickly breaking through and raising to the surface.

The above experiment was repeated but using a quantity of bitumen obtained from tar sand, which was introduced into some methylene chloride and then a water layer added on top. Now it was discovered that the interfacial film formed was much stronger than in the case noted above and, in fact, had rather the characteristics of a membrane. Upon shaking, globules of methylene chloride/bitumen solution formed in the water, which were spherical and as much as 6–8 mm in diameter. These globules sank down to the interface and persisted there for many hours, without merging back into the interface. There was no evidence of bitumen in or on the water, indicating a strong interfacial membrane-like barrier which completely retained the bitumen on the methylene chloride side. Even though the methylene chloride has about 2% solubility in water at room temperature, no bitumen could be seen.

A further experiment was made to determine if any methylene chloride was in fact in solution in the water. Upon warming up the water after decanting it from the flask, the dissolved methylene chloride was released as bubbles of vapor. Thus the strong retention of the bitumen in the methylene chloride was confirmed, even though some methylene chloride was seen to have diffused across the barrier.

A third experiment was performed to further investigate the nature of the interfacial membrane. A bitumen solution was placed under a water layer and the interfacial membrane allowed to form. Then a hollow wand was introduced through the membrane and air bubbles were blown underneath the membrane. Over several minutes to hours, the interface was distended by numerous bubbles gradually penetrating through the interfacial membrane and slowly extending therefrom, drawing with them membrane material as they rose above the interface. Some bubbles as large as 5 mm in diameter and covered with membrane material remained suspended on tethers of membrane material having 2–3 cm in length, while others broke free and drifted to the surface. Fragments of membrane could be clearly seen to be entirely free of the lower solvent/bitumen solution and slowly sank to rest on the interface. After some time, they combined with it showing that no permanent material had been formed.

The formation of the greatly extended surface shows that a very great contact angle exists, as defined by:

$$\cos\theta = (\gamma_1 - \gamma_2)/\gamma_2$$

where $\gamma_1$ = surface tension of the solvent, $\gamma_2$ = surface tension of the displacing liquid, $\theta$ = contact angle (radians), from which it can be stated that:

$$\theta >> \pi \text{ radians}$$

or $$\theta >> 90^\circ$$

for solvent + oil or bitumen to displacing liquid.

The following of the very large completely spherical globules of oil or bitumen in solvent, supported on the interfacial membrane, leads to the consideration of contact angle and wetting on the original substrate from which the oil or bitumen came. Since a strong interfacial barrier which is impermeable to the oil or bitumen is formed between the oil or bitumen solution and the displacing liquid such as water, such impermeable barrier can be used to sweep across the surface of the substrate and to dislodge the oil or bitumen solution from the surface.

As shown schematically in FIG. 1, as the displacing liquid comes into contact with the oil or bitumen solution and with the surface 4 of the substrate 6, it wets the surface 4 and spreads thereover while forming with the oil or bitumen solution the interfacial barrier 8 which moves across the surface 4 as a result of the spreading action of the displacing liquid. It is believed that the complete oil or bitumen removal is achieved due to the interfacial barrier or membrane 8 which permits the separation to occur at the molecular level or very close to it where the membrane forms and captures all the oil or bitumen in the immediate area of the wetting front of the displacing liquid, which is able to progress with the membrane moving ahead of it. Since the movement of the membrane 8 is governed by the wetting ability of the displacing liquid relative to the substrate 6, the selection of the displacing liquid is of course influenced by the spreading coefficient of this liquid on the substrate. By definition, the contact angle of a perfectly wetting liquid on a solid substrate is zero, that is to say: $\theta \approx 0°$.

The magnified portion in FIG. 1 shows that at the interface region immediately adjacent to the surface 4, the interfacial membrane 8 makes a contact angle $\theta$ close to zero as the displacing liquid wedges under the oil or bitumen solution, thus prying it off the substrate. This follows from the fact that the displacing liquid must have high wetting properties on the substrate, and must thus make a zero or close to zero contact angle on the substrate. Once the displacing liquid has wetted and covered the entire surface, the membrane 8 detaches from the surface 4 to lie flat over the liquid layer covering the surface.

Once the conditions have been established for solvent displacement from an oil or bitumen covered surface, so that the final condition is an oil or bitumen-free surface, wet with another, non-miscible solvent, such as water, the special case of sand grains must be considered. The water wet sand, surrounded by an oil or bitumen laden solvent with a strong interfacial barrier therebetween, will cause the sand grains to be forced together into clumps. There will be very little resistance to coalescense of the water shells around each sand grain. This effect was demonstrated and it was seen that the sand formed semi-solid masses, with no oil or bitumen contact, but rather remained water wet.

The specific gravity of the sand plus water is about 2.4, while that of the oil or bitumen solution is about 1.3. The sand thus sinks to the bottom, carrying the water shell with it. The shell of water remains intact, and no oil is redeposited onto the surface, even under conditions of severe disturbance of the sand grains. The sand, water wet, can thus be easily extracted from oil or bitumen solution by means of a centrifuge, or by a fluidizing technique to be described hereinbelow.

An experiment was performed to separate the water wet sand from the oil or bitumen solution without the use of a centrifuge. The accomplish this, a mixture of water wet sand and dilute oil or bitumen solution was prepared and shaken with an abrupt oscillating motion. The sand formed a layer with the oil or bitumen solution on top.

A second experiment was performed on a prepared sample of water wet sand and oil or bitumen solution. A hollow wand was used to flush the sand bed with water, which fluidized the sand and released the fraction of the oil or bitumen solution that was entrapped in the sand layer. A repeat of this experiment using clean solvent also cleared the sand layer of entrapped oil or bitumen solution, but was not as effective as the water flush method, due to the formation of enclosed clumps of sand, which were surrounded by the strong interfacial membrane, whose pressure on the clumps stabilized them, and trapped some oil or bitumen solution inside the clumps. The water, on the other hand, separated the grains since no interfacial film was formed, and caused the entrapped oil or bitumen solution to form globules with membrane-like material on their outer surfaces which rejected the sand covered with water shells. These globules then rose above the sand, merging with the water, forming a layer above the oil or bitumen solution.

In the first case, where the flushing was done with water, the entrapped oil or bitumen solution formed membrane-like material at the surfaces of the entrapped globules, but had no surface effect with the water-wet sand since no interfacial tension effect was present there. In the second case, however, the clean solvent formed an interfacial film between the solvent and the water due to the surface tension effect of solvent and water, in the absence of oil or bitumen.

It is important to note that there is a relationship between the amount of oil or bitumen in solution, and the strength of the membrane-like material. The greater the oil or bitumen concentration, the greater the strength and apparent thickness of the membrane-like material. The converse is also true, and if the oil or bitumen solution which is initially high in oil or bitumen content, and is then effectively reduced in concentration by dilution with additional solvent, the membrane-like material is seen to become weaker since, it is believed, the solvent acts to dissolve the membrane-like material and release the oil or bitumen into solution. Eventually, as more and more solvent is added, the membrane-like material disappears and a conventional interfacial film is all that remains between the solvent and the water.

The interfacial film is much more easily broken by the turbulent water wash than is the membrane-like material. Thus, an initial solvent wash to dilute the oil or bitumen solution, and hence reduce the membrane-like material, followed by the water wash to break the remaining relatively weak interfacial film, is the preferred method of clearing the entrapped oil or bitumen solution from the water wet sand.

It was noted in several of the experiments that, after the methods just given were applied, the cleaned sand grains were packed much tighter together when the sand was very cleaned. It was felt that this was due to the removal of the last traces of oil or bitumen from the surfaces of the sand grains so that the friction coefficient of sand grain to sand grain, where no oil or bitumen layer was present, was thus lower than would have been the case if residual oil or bitumen was present. The volumetric reductions noted were of the order of 2:1. That is to say, the void space between the sand grains was only half as great, when the sand was very cleaned, as when it was only slightly less cleaned. Thus, only half as much water would be expected to be trapped in the void space, leading to significant water (or displacing liquid) cost savings in a full scale plant.

A third experiment was performed using a combination of both the solvent and water simultaneously for flushing, which also diluted and carried the oil or bitumen solution out of the sand layer, and additionally dissolved any membrane-like material that was left. The water globules separated the grains by turbulent mixing, thus enhancing the separation process for both the solvent and the water. The separation of the globules of oil or bitumen solution from the globules of sand and water was complete, so that two interfaces were formed of sand+water under solvent+oil or bitumen, and solvent+oil or bitumen under water. The water films of the topmost layer of sand grains formed one side of the lower interface, at which membrane-like material was formed. The second interface formed with the water on the top layer and with the oil or bitumen solution below, also formed a membrane-like material. No oil was present in the upper water layer, even though the water forming it had passed through the sand and the oil or bitumen solution underneath, leading to the idea that the water used to form the water shells around the sand grains should preferably be in excess and that this excess can be used to aid the separation of the oil or bitumen solution from the intersticial spaces of the sand layer by physically breaking up the sand clumps and carrying the relatively lower weight globules or oil or bitumen solution out of the sand layer. In a water bath, the sand being water wet tends to be dispersed because no outer shell of surface tension film tends to form. In a solvent bath, however, the outer layers of water wet sand contribute water to the formation of a surface film or of a membrane if sufficient oil or bitumen is present, so that clumps of sand can form or globules of oil or bitumen solution can form with an outer layer of membrane-like material that must be physically removed or dissolved by the method outlined just above. As has been experimentally verified using both the solvent and water together in the same bath is an effective method of clearing entrapped oil or bitumen solution.

The experiments described above have led to the development of a practical method of cleaning tar sand grains. Obviously, if the tar sand is cleaned and the oil or bitumen is dissolved in a solvent, the latter is easily recovered by conventional solvent recovery means.

In the case of bitumen, however, experiments showed that the end of the solvent recovery step resulted in a solid which meant that the last traces of the solvent could not be recovered. To overcome this, a second solvent of higher boiling point such as kerosene was gradually substituted for the first. This second solvent was added to preserve the fluidity of the bitumen solution, as the first solvent recovery step proceded to completion. Experiment showed that there was no trace of the odor of the first solvent, e.g. methylene chloride, when 50% by volume kerosene was added to the bitumen during the first solvent recovery step. The kerosene can remain with the bitumen for pipelining the product, or can be removed by thermal distillation. Traces of chloride compounds are important in refinery processing when the amount exceeds 100 p.p.m. The levels present in the final recovered product at 150° F. were below the limit of detectability by smelling and were thus below a few parts per million of the bitumen and kerosene mixture, an insignificant amount.

Figure 2:
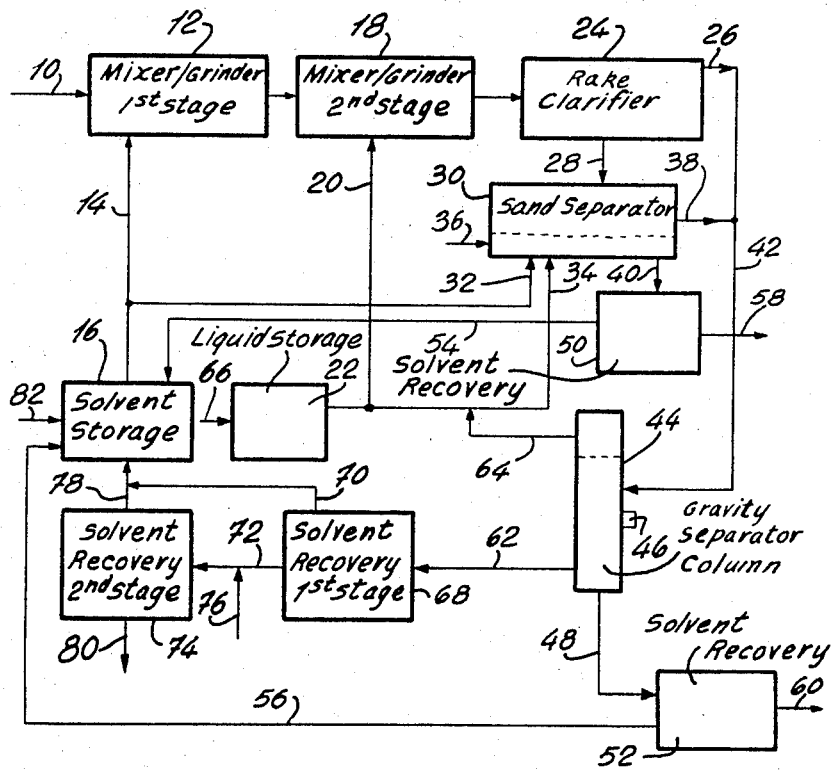
FIG. 2 is a flow diagram illustrating the application of a method according to the invention to the recovery of oil and bitumen from tar and oil sands.

Turning now to FIG. 2 which illustrates the application of the method in its entirety to the cleaning of tar or oil sand for recovering oil or bitumen therefrom, tar or oil sand crushed to size is fed through line 10 to a mixer/grinder 12 where solvent is added via line 14 from the storage tank 16. The size can be ¼" to ½" diameter size lumps, but larger or smaller size can be used, since the solvent added aids in breaking down the lumps to single grains. The primary purpose of the 1st stage mixer 12 is to reduce the lumps to grain size and thoroughly wet the oil or bitumen layer covering the sand grains to achieve the greatest amount of oil or bitumen in solution in the solvent. The finely divided sand grains together with the oil or bitumen solution formed in the 1st stage mixer 12 are passed to a second mixer/grinder 18 where a displacing liquid is added via line 20 from the storage tank 22. The 2nd stage mixer 18 provides the grain to grain contact and liquid contact opportunities which permit the displacing liquid to contact the surface of the sand grains and spread by wetting, and also spread from grain to grain by contact. As the grain to grain contact provided by the mixer 18 continues, eventually substantially all of the sand grains are wetted with the displacing liquid which forms an outer layer around each grain.

The mixture formed in the 2nd stage mixer 18 is then passed to the rake clarifier 24 where the liquid tops containing most of the oil or bitumen solution and displacing liquid are separated and taken off at 26 while the bottoms consisting of sand with solvent are liquid residues and taken off at 28 and fed to the sand separator 30. In the separator 30, the sand is allowed to form a bed which is then fluidized with both the solvent and displacing liquid fed via lines 32 and 34, respectively, and with fine bubbles of air introduced at 36 to generate turbulent mixing so as to free the entrained globules of oil of bitumen solution. The final wash is effected with only the displacing liquid so as to reduce the amount of solvent that is carried out with the sand due to the partial solubility of the solvent in the liquid layer surrounding the sand grains. The liquid tops consisting of solvent and displacing liquid with residual oil or bitumen are taken off at 38, while cleaned sand is taken off at 40.

The mixtures that are taken off at 26 and 38 are combined via line 42 and transferred to the gravity separator column 44 where a mechanical vibrator 46 provides agitation to aid in breaking any globules which may sit at the interface between the solvent and displacing liquid, and also to release sand particules which are bound to the interfacial area. This sand is removed at 48 and is added to the sand removed at 40. If the displacing liquid used is water, this may be the end of the processing for the sand, unless a water recovery need justifies recovery of the water, or unless another liquid such as an alcohol is used as displacing liquid and its cost justifies its recovery. If in a particular case excessive amounts of solvent are carried out of the sand separator 30 and gravity separator 44 with the sand at 40 and 48 respectively, then low heat or vacuum solvent recovery units 50 and 52 can be added and the recovered solvent returned to storage tank 16 via lines 54 and 56, cleaned sand with residual displacing liquid being taken off at 58 and 60, respectively.

The solvent and displacing liquid are removed from the gravity separator 44; the solvent with its oil or bitumen load is removed at 62 while the displacing liquid is removed at 64 and recycled to the mixer/grinder 18 and sand separator 24. Make-up liquid to compensate for the loss of the displacing liquid which left with the sand at 40 and 48 is added at 66. The oil or bitumen laden solvent removed at 62 is passed to a 1st stage solvent recovery distillation unit 68 where some of the solvent is removed and taken off at 70, and returned to the storage tank 16. The partly distilled mixture 72 from the 1st stage solvent recovery unit 68 is passed to a 2nd stage solvent recovery distillation unit 74, a secondary solvent being added via line 76 to ensure fluidity of the oil or bitumen in the 2nd stage solvent recovery unit 74. The balance of the primary solvent is removed at 78 and returned to the storage tank 16, while the oil or bitumen in solution in the secondary solvent is recovered at 80. Make-up solvent is added at 82.

The advantages that the method of the invention as applied to tar and oil sand cleaning have over other technologies are several. The level of recovery of the oil or bitumen approaches 100%, leaving a sand residue which will not contaminate the ground when it is returned to it. after mining. At levels of cleaning near 100%, the sand grains form a compact mass of minimum volume. At cleaning levels below this, the sand grains bridge and leave voids which increase the solvent or water retention in the processed sand, There is no tailings ponding required, since the sand is cleaned to the point where it can be considered a non-hazardous inert material. The yield for the oil or bitumen is very high, and the method is applicable to shallow depleted oil wells, tar sand deposits, and deep tight oil formations where the techniques of shaft or deep mining are employed to gain access to the oil bearing material. The method is equally effective on oil sands that contain water, such as Athabasca, or sands which do not, such as Utah or New Mexico deposits. The method is effective on deposits as lean as 6% bitumen by weight or as much as 25% by weight, with differing amounts of solvents.

The method is also applicable to asphalt pavement, where the aggregate can be recovered and the asphalt reused. The method can be used to clean oily sludges and render them inert and land-fillable; an example of this application is industrial laundry waste residue consisting of grit, metal filings, and oils. A further advantage of the method is that the solvent recovery is extremely high and the use of a secondary solvent ensures that even very viscous materials can be stripped of the primary solvent. The method does not create emulsified oil in the process of separation of the bitumen or oil. The use of surfactants is deliberately avoided, since the method involves high interfacial tensions instead of the low interfacial tension characteristics of surfactants in solution. The cost of these surfactants can be high and some of them are toxic as well, and all of these problems are avoided.

I claim:

1. A method of separating oil or bitumen from tar or oil sand without a surfactant, said oil or bitumen being adhered directly to said sand, which comprises the steps of:

(a) grinding said sand in the presence of a predetermined amount of a halohydrocarbon solvent to reduce lumps of said sand to finely divided sand grains and dissolve the oil or bitumen covering said sand grains to form a solution containing a predetermined concentration of said oil or bitumen;

(b) after step (a), mixing said finely divided sand grains and said oil or bitumen solution formed in step (a) with water, said predetermined concentration of said solution which contains oil or bitumen in said solvent being sufficient to form together with water in the presence of said oil or bitumen an interfacial membrane-like material which has a water side and is impermeable to said oil or bitumen, said mixing being carried out under conditions to provide water to grain contact and grain to grain contact whereby to cause said membrane-like material to form at the surface of each sand grain with said water side oriented toward said surface while the water wets said surface and spreads thereover, said water being present in an amount sufficient to form said membrane-like material across the entire surface of each sand grain and to thereby avoid formation of agglomerates with entrapped oil or bitumen, the water displacing said membrane-like material away from said surface as it is being formed thereacross to thereby separate said solution from said surface and cover said surface with a layer of water, said membrane-like material acting as a barrier to maintain said oil or bitumen in said solution and to prevent passage of same into said water layer;

(c) adding additional halohydrocarbon solvent to the water-wet sand produced in step (b) in an amount sufficient to substantially reduce the strength and thickness of said membrane-like material; and (d) mixing additional water with the mixture produced in step (c) under conditions of agitation of said sand grains sufficient to remove entrapped oil or bitumen solution from the water wet sand, thereby obtaining free-flowing, water-wet sand particles.

2. A method as claimed in claim 1, wherein said solvent has a substantially lower boiling point than water.

3. A method as claimed in claim 1, wherein said solvent is a chlorinated hydrocarbon selected from the group consisting of methylene chloride, trichloroethylene and perchloroethylene.

4. A method as claimed in claim 3, wherein said chlorinated solvent is methylene chloride.

5. A method as claimed in claim 1, wherein said solvent is a fluorinated hydrocarbon.

6. A method as claimed in claim 5, wherein said fluorinated hydrocarbon is trichlorotrifluorethane.

7. A method as claimed in claim 1, further comprising the step of removing traces of said solvent dissolved in said water layer in a final wash of said sand grains with water only.

8. A method as claimed in claim 1, further comprising the step of reducing the temperature of said solvent and water prior to contacting with one another and with said sand grains, so as to minimize loss of said solvent and water into each other and to increase the interfacial tension therebetween.

9. A method as claimed in claim 1, further comprising the step of recovering said oil or bitumen from said solution by stripping off said solvent therefrom, a further solvent of higher boiling point than said solvent being added as said solvent is being removed so as to maintain fluidity of said oil or bitumen.

10. A method as claimed in claim 9, wherein said further solvent of higher boiling point is kerosene.

11. A method as claimed in claim 1, wherein said grain to grain contact causes already wet sand grains to transfer part of their respective water layer to non-wet sand grains and to provide wetting of same during said mixing.

12. A method as claimed in claim 11, wherein the contacting between said sand grains is effected by grinding and tumbling of said grains.

13. A method as claimed in claim 11, wherein said wet sand grains are separated from said oil or bitumen solution by first allowing said wet grains to form a bed and then mechanically inducing motion creating shear forces so as to fluidize said bed and to thereby provide separation by relative densities.

14. A method as claimed in claim 13, wherein said bed is flushed first with said solvent and then with water, or with both said solvent and water simultaneously, under turbulent mixing.

15. A method as claimed in claim 1, wherein the amount of water mixed in step (b) is sufficient to permit coalescence of the water layers covering the surface of the sand grains to form semi-solid masses of sand grains.

16. A method as claimed in claim 1, wherein an excess amount of water is added after step (a) to separate the solution of oil or bitumen in said solvent from the water-wet sand particles.

17. A method as claimed in claim 1, wherein substantially 100% of said oil or bitumen is removed from said sand.

18. A method as claimed in claim 1, wherein the sand is cleaned to a degree sufficient to allow the sand grains to move freely against each other unimpeded by residual oil or bitumen on their surfaces and to thereby provide a smaller residual void volume between the sand grains so that the quantity of water remaining with the cleaned sand is reduced.

19. A method as claimed in claim 1, wherein the separation of the solution of oil or bitumen from the surface of the sand grains occurs substantially at the molecular level.

20. A method of recovering oil or bitumen from tar or oil sand, said oil or bitumen being adhered directly to said sand, which comprises the steps of:

(a) grinding said sand in the presence of a predetermined amount of a halohydrocarbon solvent to reduce lumps of said sand to finely divided sand grains and dissolve the oil or bitumen covering said sand grains to form a solution containing a predetermined concentration of said oil or bitumen;

(b) after step (a), mixing said finely divided sand grains and said oil or bitumen solution formed in step (a) with water, said predetermined concentration of said solution which contains oil or bitumen in said solvent being sufficient to form together with water in the presence of said oil or bitumen an interfacial membrane-like material which has a water side and is impermeable to said oil or bitumen, said mixing being carried out under conditions sufficient to provide water to grain contact and grain to grain contact whereby to cause said membrane-like material to form at the surface of each sand grain with said water side oriented towards said surface while the water wets said surface and spreads thereover, said water being present in an amount sufficient to form said membrane-like material across the entire surface of each sand grain and to thereby avoid formation of agglomerates with entrapped oil or bitumen, the water displacing said membrane-like material away from said surface as it is being formed thereacross to thereby separate said solution from said surface and cover said surface with a layer of water, said membrane-like material acting as a barrier to maintain sand oil or bitumen in said solution and to prevent passage of same into said water layer, thereby obtaining free-flowing, water-wet sand particles;

(c) separating the mixture formed in step (b) to obtain a first fraction containing a major portion of said oil or bitumen solution and water and a minor portion of said wet sand grains, and a second fraction containing a major portion of said wet sand grains and a minor portion of said oil or bitumen solution and water;

(d) separating said second fraction to obtain a third fraction containing said major portion of said wet sand grains and a fourth fraction containing said minor portion of said oil or bitumen solution and water, said separation of said second fraction comprising the steps ($d_1$) adding additional halohydrocarbon solvent to the wet sand grains of said second fraction in an amount sufficient to substantially reduce the strength and thickness of said membrane-like material, and ($d_2$) mixing additional water with the mixture produced in step ($d_1$) under conditions of agitation of said sand grains sufficient to remove entrapped oil or bitumen solution from the water wet sand;

(e) combining said first and fourth fractions and separating the combined fractions to obtain a fifth fraction containing said oil or bitumen solution, a sixth fraction containing water and a seventh fraction containing said minor portion of said wet sand grains; and (f) treating said fifth fraction to recover said oil or bitumen from said solution.

21. A method as claimed in claim 20, wherein said solvent is methylene chloride.

22. A method as claimed in claim 20, wherein the sand is cleaned to a degree sufficient to allow the sand grains to move freely against each other unimpeded by residual oil or bitumen on their surfaces and to thereby provide a smaller residual void volume between the sand grains so that the quantity of water remaining with the cleaned sand is reduced.

23. A method as claimed in claim 20, further comprising the step of reducing the temperature of said solvent and water prior to contacting with one another and with said sand grains, so as to minimize loss of said solvent and water into each other and to increase the interfacial tension therebetween.

* * * * *